US006009049A

United States Patent [19]

Huang

[11] Patent Number: 6,009,049

[45] Date of Patent: Dec. 28, 1999

[54] CLOCK MOVEMENT OF REDUCED-DIAMETER

[76] Inventor: Kuo-Chung Huang, 3F, No. 13, Alley 3, Lane 287, Sungsham Rd., Taipei, Taiwan

[21] Appl. No.: 09/033,838

[22] Filed: Mar. 3, 1998

[51] Int. Cl.[6] ..... G04B 23/02; G04B 37/00; G04C 21/16

[52] U.S. Cl. ..... 368/73; 368/88; 368/250

[58] Field of Search ..... 368/76, 80, 72–74, 368/88, 276, 295, 250, 299, 300, 309

[56] References Cited

U.S. PATENT DOCUMENTS 2,500,701 3/1950 Patterson et al. ..... 368/295
4,796,240 1/1989 Stevens ..... 368/281
5,003,519 3/1991 Noirbean ..... 368/73
5,065,374 11/1991 Soder et al. ..... 368/280
5,168,476 12/1992 Ganter et al. ..... 368/74

*Primary Examiner*—Vit Miska
*Attorney, Agent, or Firm*—Holland & Hart LLP

[57] ABSTRACT

A clock movement includes a middle body frame defining a first and a second partitions, an upper cover secured, at the first partition, to the middle body frame, and a base cover secured, at the second partition, to the middle body frame. Components for the movement are disposed in the first and second partitions enclosed, respectively. This converts a planar type arrangement of the components into a two-floor type arrangement, with the result of a decrease in diameter of the movement constructed.

4 Claims, 7 Drawing Sheets

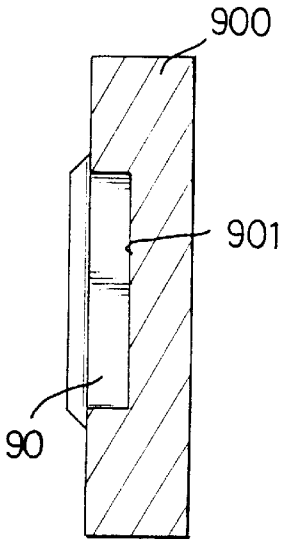
FIG.4
PRIOR ART
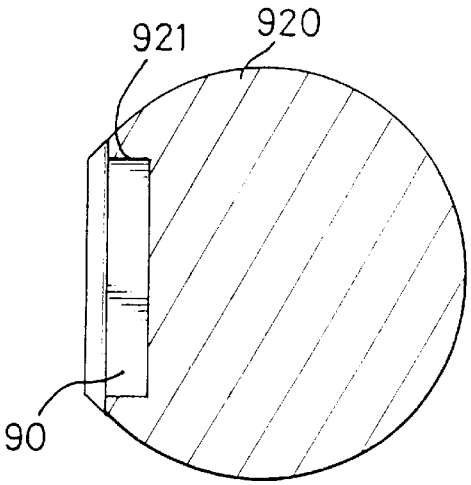
FIG.5
PRIOR ART
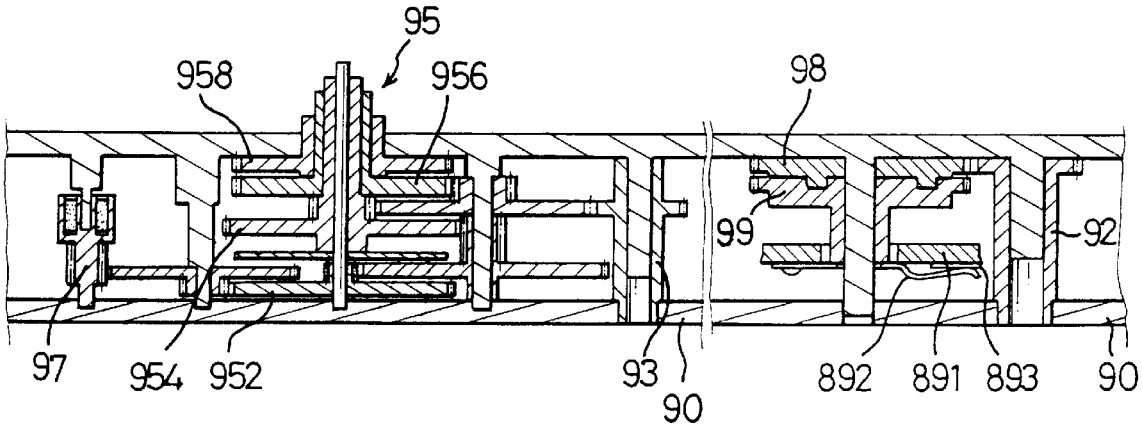
FIG.6
PRIOR ART
FIG.7
PRIOR ART

CLOCK MOVEMENT OF REDUCED-DIAMETER

BACKGROUND OF THE INVENTION

The present invention relates to clocks, and in particular to a clock movement which is of such a reduced dimension that it can be employed in locations where a limited dimension is permitted.

A clock movement is one which is to be enclosed in a case to complete a clock, while a watch movement is one which is to be enclosed in a case to form a complete watch. As is known, clock movements are used in timepieces of large dimensions and watch movements are used in watches of comparatively smaller dimensions. Namely, an ordinary clock movement has a dimension of 56 mm×56 mm×16 mm for a rectangular one and a dimension of 50 mm×8 mm for a circular one. Moreover, an ordinary watch movement has a dimension of 30 mm×4 mm or below. FIGS. 1 through 9 schematically show a general structure of the above-mentioned movement and a description thereof can be given as follows.

FIGS. 1–3 show a circular alarm clock movement seen from different views, respectively. The movement generally comprises a body 90 of a given diameter, a battery 91, an alarm setting rotor 92, an hour-setting rotor 93, a motor 94, a wheel or gear train 95, and a buzzer 96. FIGS. 4 and 5 show how the movement shown in FIGS. 1–3 is assembled to different kinds of case, respectively. FIG. 4 shows that the movement is assembled to a hole 901 of a rectangular case 900 and FIG. 5 shows that the movement is assembled to a hole 921 of a spherical case 920. FIGS. 6–7 are cross-sections showing interrelationship between the body 90, the alarm setting rotor 92, the hour-setting rotor 93 and the wheel train 95. In particular, FIG. 6 shows how a rotor 97 driven by the motor 94 is arranged within the body 90 to drive, via associated gear or gears, a second wheel 952, a minute wheel 954 and an hour wheel 956. FIG. 6 also shows how the hour-setting rotor 93 is arranged to mesh with the hour wheel 956 and the minute wheel 954. FIG. 7 shows how the alarm setting rotor 92 is arranged within the body 90 to cooperate with an upper wheel 98 which is in mesh with an alarm wheel 958 shown in FIG. 6. The upper wheel 98 in turn engages with a lower wheel 99 which meshes with the hour wheel 956 and can be moved upward and downward to control activation of the buzzer 91. The upward and downward movement of the lower wheel 99 with respect to the upper wheel 98 can be achieved by providing protrusions 982 and recesses 992 thereon, respectively, as shown in FIGS. 8 and 9. It is noted that, as is known in this art, within the body 90 of the movement there is a circuit substrate containing associated electric driving circuits and the like to complete the above-mentioned movement, although it is not specifically described herein.

In FIGS. 6 and 7, if the alarm wheel 958, the upper and lower wheels 98 and 99, the alarm-setting rotor 92, the buzzer 91 and related contact blades are removed, the alarm clock movement simply becomes a clock movement without an alarm function.

In practice, where it is desired that a movement be put into a case having a hole of, for example, 35 mm or below in diameter, only watch movements having a dimension of 30 mm×4 mm or below can be used. Since watch movements are more expensive to manufacture than clock movements, it will be a saving of cost if clock movements can be used in this case. This is possible where an increase in thickness of the movement due to a decrease in diameter of the movement is not important in many applied cases.

Applicant has found that the gear train itself does not occupy a large percentage of a total diameter of the movement. It has further been observed that the motor, the battery and the buzzer together consume a large space, and these components, arranged side-by-side with the gear train, contribute to the dimension an ordinary movement now exhibits.

BRIEF SUMMARY OF THE INVENTION

A primary object of the present invention is to provide a movement of a reduced diameter so that it can be accommodated in a hole of a smaller diameter. This is achieved, according to the present invention, by re-arranging the above-mentioned components comprised of an ordinary movement in a substantially two-floor body or double-decker. Under this arrangement, the wheel train and associate components are placed within one floor and the motor and the buzzer, and optionally the battery, are placed in the other floor and therefore the lateral dimension or diameter of the body can be reduced.

An advantage of the movement constructed in accordance with the present invention is saving of cost.

Other objects, advantages and novel features of the invention will become more apparent from the following detailed description when taken in conjunction with the accompanying drawings.

BRIEF DESCRIPTION OF THE SEVERAL VIEWS OF THE DRAWING

FIG. 4 is a side, partly cross-sectional view showing the prior art alarm clock movement of FIG. 1 mounted to a rectangular case;

FIG. 5 is a side, partly cross-sectional view showing the prior art alarm clock movement of FIG. 1 mounted to a spherical case;

FIG. 6 gives a partial, side cross-section of the prior art alarm clock movement shown in FIG. 1;

FIG. 7 gives another partial, side cross-section of the prior art alarm clock movement shown in FIG. 1;

DETAILED DESCRIPTION OF THE INVENTION

Figure 1:
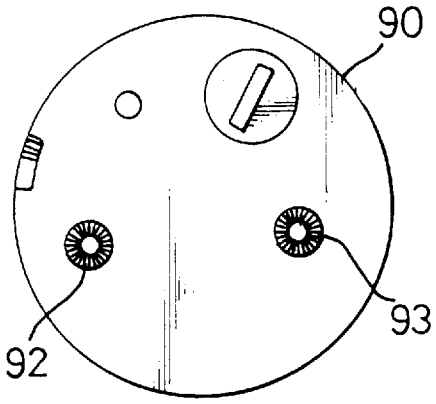
FIG.1 PRIOR ART
FIG. 1 gives a rear view of a prior art alarm clock movement.
Figure 2:
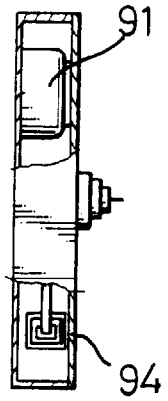
FIG.2 PRIOR ART
FIG. 2 gives a side, partly cross-sectional view of the prior art alarm clock movement shown in FIG. 1.
Figure 3:
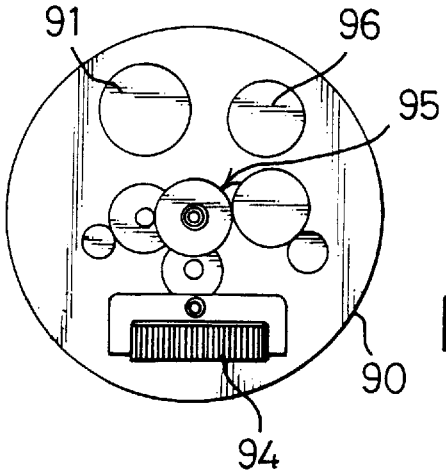
FIG.3 PRIOR ART
FIG. 3 gives a schematic front view of the prior art alarm clock movement shown in FIG. 1.
Figure 8:
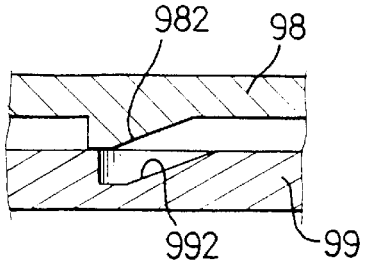
FIG. 8 PRIOR ART
FIG. 8 gives the relationship between an upper wheel and a lower wheel of the prior art alarm clock movement shown in FIG. 1, in which the lower wheel is in a downward position.
Figure 9:
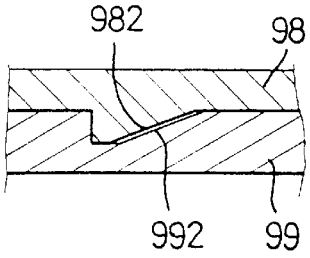
FIG. 9 PRIOR ART
FIG. 9 is a view similar to FIG. 8 but giving the lower wheel in an upward position.
Figure 10:
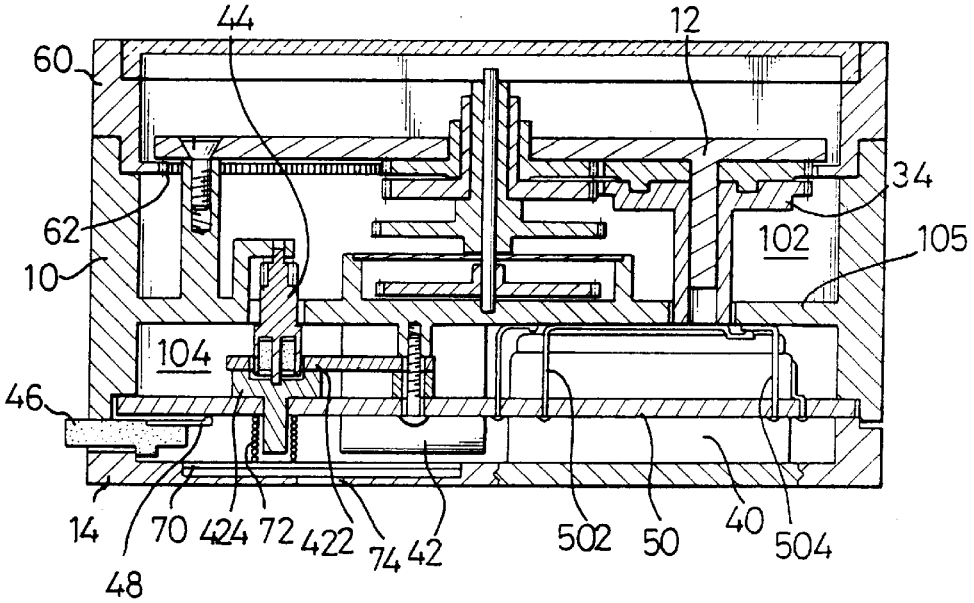
FIG. 10 shows a cross-section of a movement in accordance with the present invention.
Figure 11:
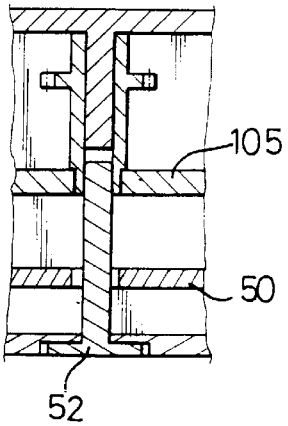
FIG. 11 shows a partly broken-away cross-section of the movement of FIG. 10.
Figure 14:
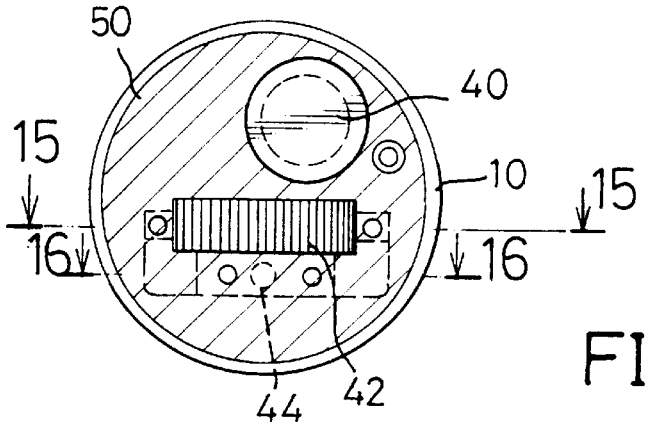
FIG. 14 shows another rear view of the movement of FIG. 10 in which a base cover is removed.
Figure 13:
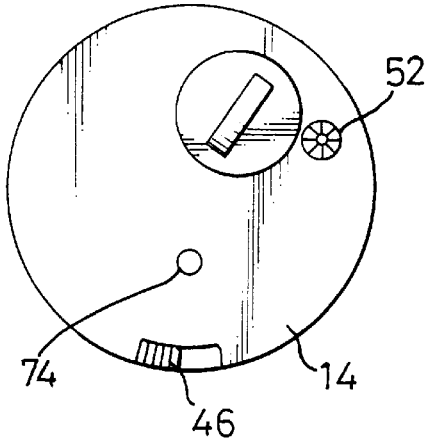
FIG. 13 shows a rear view of the movement of FIG. 10.
Figure 12:
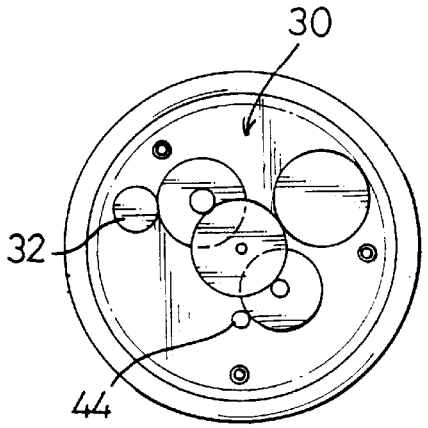
FIG. 12 shows a front view of the movement of FIG. 10.

Referring to the drawings and initially to FIGS. 10–14, the movement constructed in accordance with the present invention can be seen in different views. As mentioned previously, the present invention employs those existing elements, such as a wheel or gear train 30, a battery 40, a motor 42 and a circuit substrate 50 carrying necessary electric circuits thereon, that are present in an ordinary movement but accommodates them in a novel encasing structure to obtain a compact movement. The encasing structure will be described later with particular reference to FIG. 10. In FIGS. 12–14, a rotor 44 constituting part of the motor 42, an hour-setting rotor 32, an alarm-setting knob 46 and an outlet 74 for sound can also be seen.

The encasing structure comprises a middle body frame 10, an upper cover 12 and a base cover 14. The middle body frame 10 has an intermediate web 105 which divides the middle body frame 10 into an upper partition 102 and a lower partition 104. The upper cover 12 is secured, at the upper partition 102, to the middle body frame 10, while the base cover 14 is secured, at the lower partition 104, to the middle body frame 10. The upper cover 12 and the middle body frame 10 together are adapted to support the wheel or gear train 30. Specifically, the rotor 44 driven by the motor 42 to rotate in a conventional way extends through the web 105 to operate the wheel train 30 via suitable gear/gears (not shown). The base cover 14 and the middle body frame 10 together are adapted to receive the battery 40, the motor 42 and the circuit substrate 50.

The hour-setting rotor 32 is generally of a known construction and extends through the web 105 and the base cover 14 to be manipulatable from outside by a user. However, the alarm-setting gear 34 does not extend through the base cover 14 but instead terminates at the web 105. As is known, the gear 34 is composed of an upper wheel and a lower wheel which can be moved downward by the upper wheel. When the lower wheel is moved downward, it interrupts an established electrical connection between a pair of conductive blades 502 and 504. To manipulate the alarm-setting gear 34, an alarm-setting ring 60 is provided. The ring 60 is rotatably mounted on the middle body frame 10. The alarm-setting ring 60 has an inner-tooth portion 62 which is restrained by an outermost portion of the upper cover 12 so that the ring 60 is prevented from departing the middle body frame 10. The inner-tooth portion 62 engages an upper wheel of the alarm-setting gear 34 so the ring 60 acts as an internal gear capable of being manipulated to drive the alarm-setting gear 34. Moreover, to control activation of the buzzer 70 which is placed on the base cover 14 and is electrically connected to the circuit substrate 50 via spring contacts 72, the alarm-setting knob 46 is suitably supported between the middle body frame 10 and the base cover 14. The knob 46 serves as an ON/OFF switch which acts on a metal contact blade 48 provided on the circuit substrate 50 (shown in FIGS. 17 and 18) to complete/disconnect an associated circuitry. With the above arrangement, a conventional movement of a dimension 50 mm (diameter)×8 mm (height) can be converted to a movement of a dimension 30 mm×15 mm with corresponding components. Comparing with the watch movement (gear data shown in Table 1), the gears constructed in the present invention can be much larger and easy to manufacture (gear data shown in Table 2).

TABLE 1

(example of 30 mm diameter watch movement gear data)

| Gear name | Pinion/Gear | Module (mm) | Tooth number | Pitch diameter (mm) | Center distance (mm) |
|---|---|---|---|---|---|
| Motor gear | Pinion | 0.06 | 8 | 0.48 | 1.44 |
| 1st gear | Gear | 0.06 | 40 | 2.4 | |
| | Pinion | 0.06 | 8 | 0.48 | 1.68 |
| Second wheel | Gear | 0.06 | 48 | 2.88 | |
| | Pinion | 0.055 | 8 | 0.44 | 1.98 |
| 2nd gear | Gear | 0.055 | 64 | 3.52 | |
| | Pinion | 0.0582 | 8 | 0.4656 | 1.98 |
| Minute wheel | Gear | 0.0582 | 60 | 3.492 | |
| | Pinion | 0.0825 | 12 | 0.99 | 1.98 |
| 3rd gear | Gear | 0.0825 | 36 | 2.97 | |
| | Pinion | 0.099 | 8 | 0.792 | 1.98 |
| Hour wheel | Gear | 0.099 | 32 | 3.168 | |

TABLE 2

(example of 50 mm diameter clock diameter gear data)

| Gear name | Pinion/Gear | Module (mm) | Tooth number | Pitch diameter (mm) | Center distance (mm) |
|---|---|---|---|---|---|
| Motor gear | Pinion | 0.2 | 8 | 1.6 | 4.8 |
| 1st gear | Gear | 0.2 | 40 | 8 | |
| | Pinion | 0.2 | 8 | 1.6 | 5.7 |
| Second wheel | Gear | 0.2 | 48 | 9.6 | |
| | Pinion | 0.16 | 8 | 1.28 | 5.84 |
| 2nd gear | Gear | 0.16 | 64 | 10.24 | |
| | Pinion | 0.1694 | 8 | 1.355 | 5.84 |
| Minute wheel | Gear | 0.1694 | 60 | 10.164 | |
| | Pinion | 0.24 | 12 | 2.88 | 5.84 |
| 3rd gear | Gear | 0.24 | 36 | 8.64 | |
| | Pinion | 0.256 | 9 | 2.304 | 5.84 |
| Hour wheel | Gear | 0.256 | 36 | 9.216 | |
| Hour-setting rotor | Pinion | 0.24 | 18 | 4.32 | 6.48 |

The above gears/wheels in Table 2 can be enclosed in a 30 mm diameter space after proper rearrangement.

Figure 15:
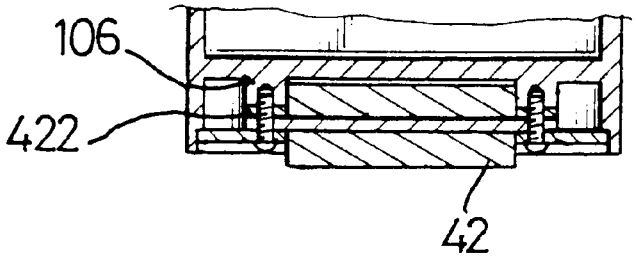
FIG. 15 shows a cross-section taken along line 15—15 of FIG. 14.
Figure 16:
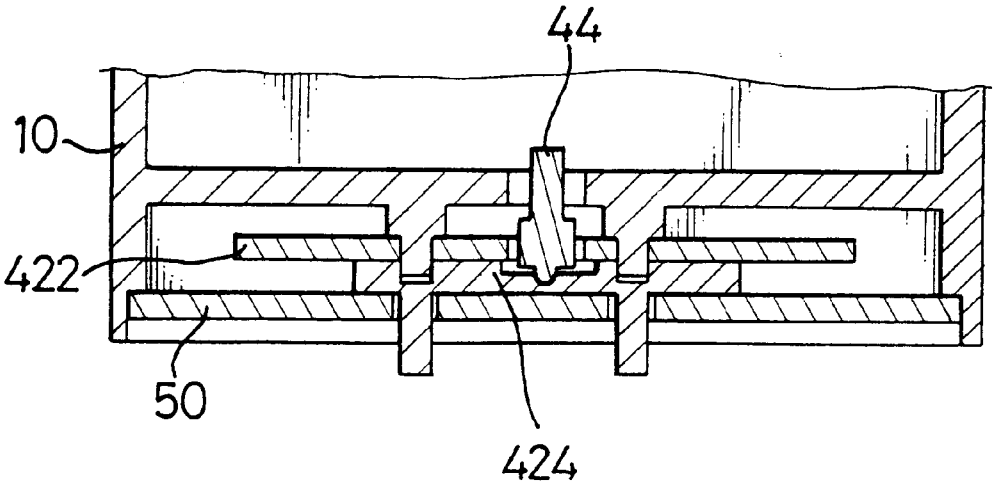
FIG. 16 shows a cross-section taken along line 16—16 of FIG. 14.

FIGS. 15 and 16 both show how the motor 42 and its outer stator 422 are mounted to the middle body frame 10. As can be seen, the outer stator 422 is fixed, for example by screws, to posts 106 integrally extended downward from a bottom of the web 105. Between the outer stator 422 and the circuit substrate 50, there is disposed a bearing 424 for the rotor 44. The rotor 44 passes through the outer stator 422 and rests on the bearing 424. The bearing 424 has posts which extend through the circuit substrate 50.

Figure 17:
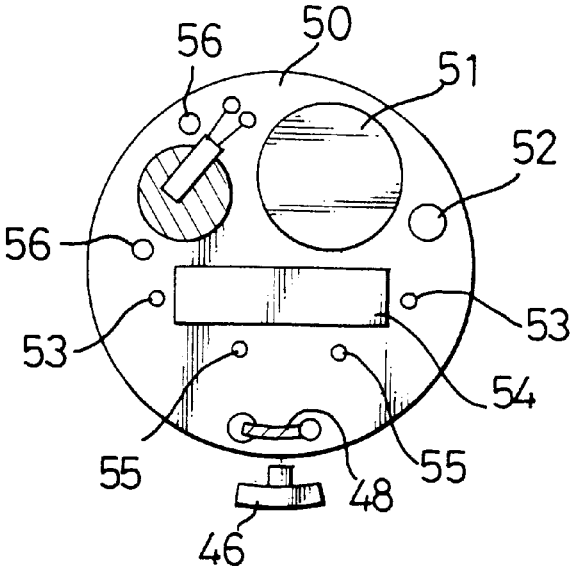
FIG. 17 shows the outline of a circuit substrate employed in the movement of the invention.
Figure 18:
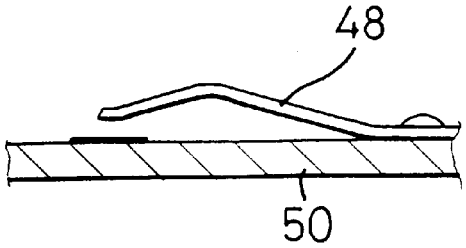
FIG. 18 shows the arrangement of a contact blade used with an alarm-setting knob.

FIG. 17 shows the outline of the circuit substrate 50. On the circuit substrate 50, a number of holes are made to provide passages for several of the constituting components of the movement. Specifically, hole 51 is for passage of the battery 40, hole 52 is for passage of the hour-setting rotor 32, holes 53 and 54 for the motor 42, and holes 55 for the posts of the bearing 424. Holes 56 are made for soldering of the conductive blades 502 and 504. Description of other elements on the circuit substrate which are required but are not of relevance to the present invention is believed not necessary and therefore is omitted herein.

Figure 19:
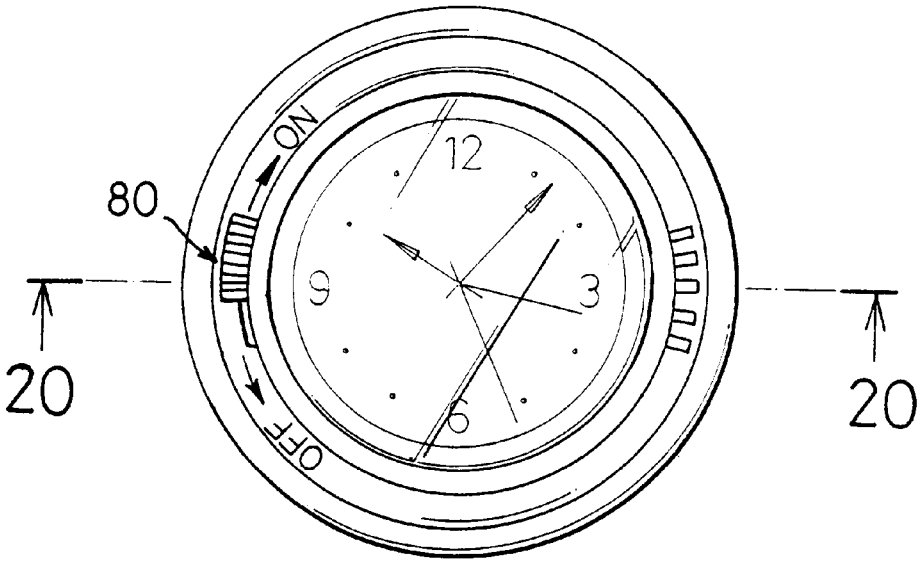
FIG. 19 is a front view showing a modified alarm-setting knob design.
Figure 20:
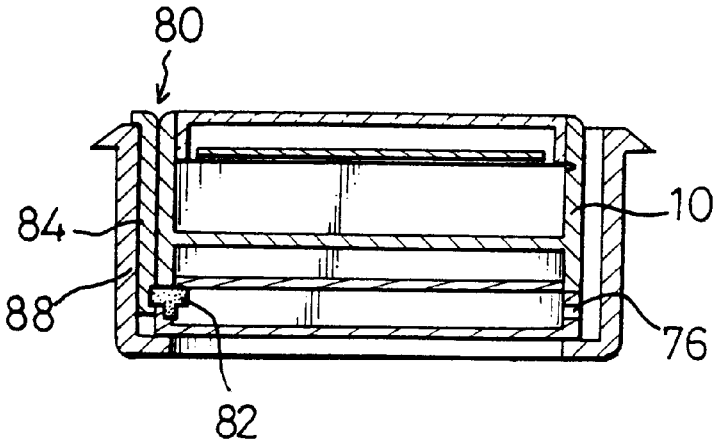
FIG. 20 is a cross-section taken along line 20—20 of FIG. 19.

FIGS. 19 and 20 show an alarm-setting knob 80 of a modified form, in a front view and a cross-sectional view, respectively. In addition to a knob 82 similar to the knob 46, the alarm-setting knob 80 further comprises a stem 84 secured to the knob 82 and extending upward to a top of the middle body frame 10. Moreover, an outlet 76 for sound is provided on the base cover 14 and an outer case 88 having an inner wall spaced from the movement is provided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A clock or alarm clock movement comprising:

a middle body frame having a web, the web dividing the middle body frame into a first and a second partitions;

an upper cover secured, at the first partition, to the middle body frame, the upper cover and the middle body frame together being adapted to support a gear train; and a base cover secured, at the second partition, to the middle body frame, the base cover and the middle body frame together being adapted to receive a motor and a circuit substrate.

2. The movement as claimed in claim 1, wherein the base cover and the middle body frame together are further adapted to receive a battery.

3. The movement as claimed in claim 1, further comprising:

an alarm-setting ring rotatably mounted on the middle body frame, the alarm-setting ring having an inner-tooth portion restrained by the upper cover from falling off the middle body frame, the inner-tooth portion being adapted to drive an alarm-setting gear; and an alarm-setting knob supported between the middle body frame and the base cover, the alarm-setting knob being adapted to activate a buzzer.

4. The movement as claimed in claim 3, wherein the alarm-setting knob comprises a stem extending upward to a top of the middle body frame.

* * * * *